United States Patent [19]

Tamura et al.

[11] Patent Number: 4,973,421

[45] Date of Patent: Nov. 27, 1990

[54] AZEOTROPIC SOLVENT COMPOSITION

[75] Inventors: Kohji Tamura, Kawanishi; Yukio Omure, Takatsuki; Satoshi Ide, Osaka; Naoyoshi Hanatani; Toshimasa Fukuzawa, both of Settsu, all of Japan

[73] Assignee: Daikin Industries, Ltd., Osaka, Japan

[21] Appl. No.: 298,097

[22] Filed: Jan. 18, 1989

[30] Foreign Application Priority Data

Jan. 22, 1988 [JP] Japan ..... 63-13145

[51] Int. Cl.[5] ..... C11D 7/30; C11D 7/50

[52] U.S. Cl. ..... 252/171; 252/162; 252/170; 252/364; 252/DIG. 9

[58] Field of Search ..... 252/DIG. 9, 162, 170, 252/171, 364, 67, 69; 134/12, 38, 39, 40

[56] References Cited

U.S. PATENT DOCUMENTS

| | | | |
|---|---|---|---|
| 2,748,084 | 5/1956 | De Lew et al. | 252/172 |
| 2,999,815 | 9/1961 | Eiseman, Jr. | 252/171 |
| 2,999,816 | 9/1961 | Bennet et al. | 252/171 |
| 3,249,546 | 4/1966 | Eiseman | 252/67 |
| 3,340,199 | 9/1967 | Clay et al. | 252/171 |
| 3,593,462 | 11/1970 | Schofield | 252/170 |
| 3,607,767 | 9/1971 | Schofield et al. | 252/171 |
| 4,279,665 | 7/1981 | Colbert et al. | 134/38 |
| 4,476,036 | 10/1984 | Figel et al. | 252/171 |
| 4,517,108 | 5/1985 | Hisamoto et al. | 252/162 |
| 4,599,187 | 7/1986 | Hey | 252/171 |

*Primary Examiner*—Paul Lieberman
*Assistant Examiner*—A. Beadles-Hay
*Attorney, Agent, or Firm*—Armstrong, Nikaido, Marmelstein, Kubovcik & Murray

[57] ABSTRACT

An azeotropic solvent composition which comprises an azeotropic mixture of 77% by weight of Flon-113 and 23% by weight of cyclopentane. The composition can decrease the amount of 1,1,2-trichloro-1,2,2-trifluoroethane excellent in power for dissolving fats and oil, grease, and particularly, waxes used for temporarily fixing silicon wafers, quartz, ceramics without erosion of materials made of plastics and rubbers, and it is easy to control the liquid composition and easy to recover and reuse the composition.

2 Claims, No Drawings

AZEOTROPIC SOLVENT COMPOSITION

BACKGROUND OF THE INVENTION

The present invention relates to an azeotropic solvent composition comprising an azeotropic mixture of 1,1,2-trichloro-1,2,2-trifluoroethane (hereinafter referred to as "Flon-113") and cyclopentane.

Flon-113, one of the chlorofluoroethane compounds, has various advantages such as good incombustibility, low toxity to living bodies and excellent selective solvent power that it can dissolve fats and oils, greases, waxes, and the like without erosion of high molecular compounds such as plastics and rubbers. Accordingly, Flon-113 is widely used alone or as a mixture or azeotropic composition thereof with an other organic solvent, as a solvent, a cleaning solvent, or the like.

Recently, a problem of environmental pollution-that chlorofluoroethane compounds in which all hydrogen atoms of ethane are substituted with chlorine atoms and fluorine atoms (hereinafter referred to as "perhaloethanes") such as Flon-113 destroy the ozone layer surrounding the earth-has been raised on a global scale. Therefore, it is immediately required to decrease the used amount of such perhaloethanes.

Then, substances substitutive for Flon-113 have been variously studied, but no suitable substitute has been found.

On the other hand, mixed solvents of Flon-113 with an other organic solvent have been practically used. However, for using Flon-113 as the mixed solvent, it is required to easily control the liquid composition of the solvent and to easily recover and reuse the solvent. Moreover, it is desired that the solvent can be applied to steam cleaning.

Mixed solvents satisfying the above requirements cannot be obtained by only mixing Flon-113 with one or more kinds of the other solvents. That is, it is necessary that the mixture made is a mixture having an azeotropic point, in other words, the mixture is made azeotropic.

As such an azeotropic mixture of Flon-113, an azeotropic mixture of Flon-113 with methanol or ethanol is known. However, both the azeotropic mixtures have a low alcohol content, only less than 10 % by weight (methanol content: 6 % by weight, ethanol content: 4 % by weight). Accordingly, the azeotropic mixtures of Flon113 with the alcohol are very unsatisfactory from the viewpoint of decrease of the used amount of Flon-113.

An azeotropic mixture of Flon-113 and methylene chloride having a mixing ratio of Flon-113 to methylene chloride of 1 : 1 by weight is also practically used, but it is not desirable, since methylene chloride has high toxity to living bodies.

An object of the present invention is to provide an azeotropic composition capable of further improving cleaning power, in other words power for removing wax, of Flon-113 and capable of decreasing the amount of Flon-113 used.

This and other objects of the present invention will become apparent from the description hereinafter.

SUMMARY OF THE INVENTION

In accordance with the present invention, there is provided an azeotropic solvent composition comprising an azeotropic mixture of 77 % by weight of 1,1,2-trichloro-1,2,2-trifluoroethane and 23 % by weight of cyclopentane.

DETAILED DESCRIPTION

In the present invention, the azeotropic mixture is composed of 77 % by weight of Flon-113 having the boiling point of 47.6° C. and 23 % by weight of cyclopentane having the boiling point of 49.0° C. The mixture has the azeotropic point of 45.4° C.

Cyclopentane has not particularly been known to be used as a solvent or a cleaning solvent, therefore it has not been used as a solvent for removing waxes. Further, cyclopentane harms plastics and rubbers not a little. Accordingly, it is difficult to wholly wash materials, which are made of plastics, rubbers and the like with cyclopentane.

In the present invention, not only the amount of Flon-113 used can be greatly decreased, since the azeotropic composition of the present invention is composed of Flon-113 and cyclopentane in the weight ratio of Flon-113 to cyclopentane of 77/23, but also the materials to be washed, made of plastics or rubbers can be wholly washed with the azeotropic composition, since the composition does not harm the materials. Also, since the composition is azeotropic, it is easy to control the liquid composition and to recover and reuse the composition. Furthermore, the composition can be applied to steam cleaning.

Although the azeotropic composition of the present invention is chemically stable, stabilizers may be added thereto.

It is preferred that the stabilizers can be distilled together with the composition, more desirably the mixture can form an azeotropic system, in addition that the stabilizers have a large effect for stabilizing the composition.

Examples of the stabilizers are, for instance, aliphatic nitro compounds such as nitromethane, nitroethane and nitropropane; acetylene alcohols such as 3-methyl-1-butyne-3-ol and 3-methyl-1-pentyne-3-ol; epoxides such as glycidol, methyl glycidyl ether, allyl glycidyl ether, phenyl glycidyl ether, 1,2-butylene oxide, cyclohexene oxide and epichlorohydrin; ethers such as dimethoxymethane, 1,2-dimethoxyethane, 1,4-dioxane and 1,3,5-trioxane; unsaturated hydrocarbons such as hexene, heptene, octene, 2,4,4-trimethyl-1-pentene, pentadiene, octadiene, cyclohexene and cyclopentene; olefinic alcohols such as allyl alcohol, 1-butene-3-ol and 3-methyl-1-butene-3-ol; acrylates such as methyl acrylate, ethyl acrylate and butyl acrylate; and the like. These stabilizers can be used alone or as an admixutre thereof. In addition thereto, other compounds may be used. In such a case as the stabilizer is used with the other compounds, synergic stabilizing effect can be obtained. Examples of the other compounds are, for instance, phenols such as phenol, trimethylphenol, cyclohexylphenol, thymol, 2,6-di-t-butyl-4-methylphenol, butylhydroxyanisole and isoeugenol; amines such as hexylamine, pentylamine, dipropylamine, diisopropylamine, diisobutylamine, triethylamine, tributylamine, pyridine, N-methylmorpholine, cyclohexylamine, 2,2,6,6-tetramethylpiperidine and N,N'-diallyl-p-phenylenediamine; toriazoles such as benzotriazole, 2-(2'-hydroxy-5'-methylphenyl)benzotriazole and chlorobenzotriazole; and the like.

An amount of the stabilizers is suitably determined according to kinds of the stabilizers, and is generally from 0.1 to 10 % by weight, preferably from 0.5 to 5 % by weight, based on the azeotropic composition.

The azeotropic composition of the present invention having the above-mentioned advantages is suitable for use as the cleaning solvent, e.g., for removing oils and fats, grease, and the like, and for removing waxes used for temporarily fixing silicon wafers used in semiconductors, quartz and ceramics in their processing such as cutting or polishing.

The composition of the present invention can decrease the used amount of Flon-113 which is considered to cause destruction of the ozone layer. Also, the composition can exhibit that Flon-113 and cyclopentane are well-balanced in dissolving power. Also, it is easy to control the liquid composition and easy to recover and reuse the composition. Futhermore, the composition has an excellent property such that kinds of materials to be dissolved can be increased.

The present invention is more specifically described and explained by means of the following Examples, in which all % are by weight otherwise noted. It is to be understood that the present invention is not limited to the Examples and various changes and modifications may be made in the invention without departing from the spirit and scope thereof.

EXAMPLE 1

A distillation flask was charged with a mixture of 150 g of Flon-113 and 150 g of cyclopentane. The mixture was distilled under normal pressure in a rectification tower having a theoretical plate number of 30 to obtain a distillate having a azetropic point of 45.4° C.

As a result of gaschromatography analysis, it was confirmed that the distillate consisted of 77 % of Flon-113 and 23 % of cyclopentane.

As the azeotropic composition of Flon-113 and cyclopentane, the dissolving power to various waxes and effects on plastic (degree of swelling) were measured as follows:

Dissolving power

A 200 ml beaker is charged with 100 g of the azeotropic composition (solvent), and to the composition is gradually added with stirring at room temperature a powder of a paraffin wax shown in Table 1, used for temporarily fixing silicon wafers.

The results are shown in Table 1.

◎: Wax is dissolved in the solvent in a concentration of more than 2%.
○: Wax is dissolved in the solvent in a concentration of 1 to 2%
Δ: Wax is dissolved in the solvent in a concentration of less than 1%.
×: Wax is not dissolved in the solvent.

Effects on plastic

A 100 ml glass autoclave is charged with 100 g of the azeotropic composition and a plastic test piece (5 mm ×50 mm ×2 mm), whose weight is measured prior to charging in the antoclave, shown in Table 1. After allowing the autoclave to stand in a thermostat having a temperature of 50° C. for 4 hours, the test piece is taken out from the composition, and immediately the weight and volume of the test piece are measured. As to the weight and volume of the plastic test piece, a ratio of increase is calculated.

The results are shown in Table 2.

◎: A ratio of increase of the weight or volume is less than 1%.
○: A ratio of increase of the weight or volume is from 1 to 3%.
Δ: A ratio of increase of the weight or volume is from 3 to 5%.

COMPARATIVE EXAMPLES 1 and 2

As to Flon-113 (Comparative Example 1) and cyclopentane (Comparative Example 2), the dissolving powder and effects on plastic were examined in the same manner as in Example 1.

The results are shown in Table 1.

TABLE 1

| | | Dissolving power Melting point of waxes* | | | | Effects on plastic Plastic test piece | | | |
|---|---|---|---|---|---|---|---|---|---|
| | Solvent | 52° C. | 57° C. | 60° C. | 65° C. | Vinyl chloride resin | ABS resin | Polypropylene | Acrylonitrilie resin |
| Ex. 1 | Composition of 77% of Flon-113 and 23% of cyclopentane | ◎ | ◎ | ○ | Δ | ◎ | ◎ | ○ | ◎ |
| Com. Ex. 1 | Flon-113 | ○ | ○ | × | × | ◎ | ◎ | ◎ | ◎ |
| Com. Ex. 2 | Cyclopentane | ◎ | ◎ | ○ | Δ | ○ | Δ | Δ | Δ |

(Note)
*All four kinds of the paraffin waxes having the different melting point are commercially available from Nippon Seiro Co., Ltd..

In addition to the ingredients used in the Examples, other ingredients can be used in the Examples as set forth in the specification to obtain substantially the same results.

What we claim is:

1. An azeotropic solvent composition consisting essentially of an azeotropic mixture of 77 % by weight of 1,1,2-trichloro-1,2,2-trifluoroethane and 23 % by weight of cyclopentane and having a boiling point of about 45.4° C. at normal pressure.

2. An azeotrope consisting essentially of 77 % by weight of 1,1,2,-trichloro-1,2,2-trifluoroethane and 23 % by weight of cyclopentane.

* * * * *